US005482028A

United States Patent [19]

Binzer

[11] Patent Number: 5,482,028

[45] Date of Patent: Jan. 9, 1996

[54] MODULAR FIREPLACE INSERT WITH MOVABLE MANIFOLD

[76] Inventor: Lothar Binzer, 5721 124th Street, Surrey, B.C. Canada, V3W 3J5

[21] Appl. No.: 125,529

[22] Filed: Sep. 22, 1993

[51] Int. Cl.[6] ..... F24C 3/00

[52] U.S. Cl. ..... 126/512; 126/80; 126/85 B; 126/531

[58] Field of Search ..... 126/512, 523, 126/528, 500, 531, 80, 312, 83, 85 B, 92 B, 85 R, 503, 307 R; 431/125, 110, 112; 237/53–55

[56] References Cited

U.S. PATENT DOCUMENTS

| | | | |
|---|---|---|---|
| 3,741,194 | 6/1973 | Herron . | |
| 3,842,821 | 10/1974 | Juris . | |
| 4,111,004 | 9/1978 | Blomberg | 126/85 B |
| 4,259,941 | 4/1981 | Gerdes . | |
| 4,329,976 | 5/1982 | Jackson | 126/77 |
| 4,519,376 | 5/1985 | Schoeff et al. . | |
| 4,683,623 | 8/1987 | Cannata . | |
| 4,793,322 | 12/1988 | Shimek et al. . | |
| 4,940,042 | 7/1990 | Moore, Jr. et al. . | |
| 5,009,219 | 4/1991 | Liet . | |
| 5,016,609 | 5/1991 | Shimek et al. | 126/85 B |
| 5,092,313 | 3/1992 | Blackburn et al. . | |
| 5,191,877 | 3/1993 | Shimek et al. | 126/512 |
| 5,267,552 | 12/1993 | Squires et al. | 126/512 |
| 5,299,558 | 4/1994 | Binzer | 126/512 |
| 5,320,086 | 6/1994 | Beal et al. | 126/512 |

FOREIGN PATENT DOCUMENTS

| | | | |
|---|---|---|---|
| 217701 | 6/1924 | United Kingdom | 126/85 B |
| 2082761 | 3/1982 | United Kingdom | 126/85 B |

*Primary Examiner*—James C. Yeung

*Attorney, Agent, or Firm*—Flehr, Hohbach, Test, Albritton & Herbert

[57] ABSTRACT

A fireplace insert for a fireplace cavity formed in a building with a fresh air inlet and a combustion gas outlet. The insert includes an enclosure dimensioned to be insertable within the fireplace cavity to define a combustion chamber for generating heat. A manifold is provided for distributing fresh air from the fresh air inlet to the combustion chamber. The manifold means is positionable at a predetermined location within the fireplace cavity according to the position of the fresh air inlet. A duct communicates the combustion chamber with the combustion gas outlet.

10 Claims, 4 Drawing Sheets

MODULAR FIREPLACE INSERT WITH MOVABLE MANIFOLD

FIELD OF THE INVENTION

This invention relates to a direct vent fireplace insert for fitting into a pre-formed fireplace cavity.

BACKGROUND OF THE INVENTION

Fireplace inserts that can be fitted into a pre-formed cavity built into the wall of a dwelling are well known. Examples of various inserts can be found in the following patents:

U.S. Pat. No. 4,519,376 to Schoeff et al

U.S. Pat. No. 5,009,219 to Liet

U.S. Pat. No. 3,842,821 to Juris

U.S. Pat. No. 4,683,623 to Cannata

U.S. Pat. No. 4,793,322 to Shimek et al

In many cases, the fireplace inserts are direct vent inserts that receive outside air for combustion through a fresh air inlet and vent combustion gases through a venting passage or outlet. Generally, the inlet and outlet comprise tubular ducts that are arranged co-axially such that the heated combustion gases pre-heat the outside fresh air. Often the inlet and outlet ducts extend upwardly from the fireplace cavity. This top vent configuration is common when the insert is used within an old fireplace cavity that vents through the existing chimney structure. Alternatively, the fireplace insert can be vented by an inlet and outlet extending rearwardly from the insert through the building wall to the outside in a rear vent configuration.

Fireplace inserts are generally of modular construction to allow for quick adaptation or modification of the basic insert unit to fit into the large number of the fireplace cavities that would normally be encountered. However, there is still the need to have on hand at least two outer fireplace shells to accommodate the top vent and rear vent configurations leading to additional inventory and storage costs.

A previous solution to this problem involved a hybrid outer shell design having an upper and lower connection extending from a rear surface of the fireplace insert angled at 45 degrees. The upper connection is used when the unit is installed in a cavity having top venting and the lower connection is used when the unit is installed in a rear vent cavity. In either case, the unused connection would be blocked off. This solution is wasteful of materials since each fireplace insert includes a connection that will not be used.

SUMMARY OF THE INVENTION

Therefore, there is a need for a fireplace insert that can be quickly and efficiently converted between various venting configurations.

Accordingly, the present invention provides a fireplace insert for a fireplace cavity formed in a building with a fresh air inlet and a combustion gas outlet comprising:

an enclosure dimensioned to be insertable within the fireplace cavity to define a combustion chamber for generating heat;

manifold means for distributing fresh air from the fresh air inlet to the combustion chamber, the manifold means being positionable at a predetermined location within the fireplace cavity according to the position of the fresh air inlet; and connection means for communicating the combustion chamber with the combustion gas outlet.

The manifold means of the present invention permits a single fireplace insert to be adaptable for use in a rear vent or top configuration.

BRIEF DESCRIPTION OF THE DRAWINGS

Aspects of the present invention are illustrated, merely by way of example, in the accompanying Figures in which.

DESCRIPTION OF THE PREFERRED EMBODIMENTS

Figure 1:
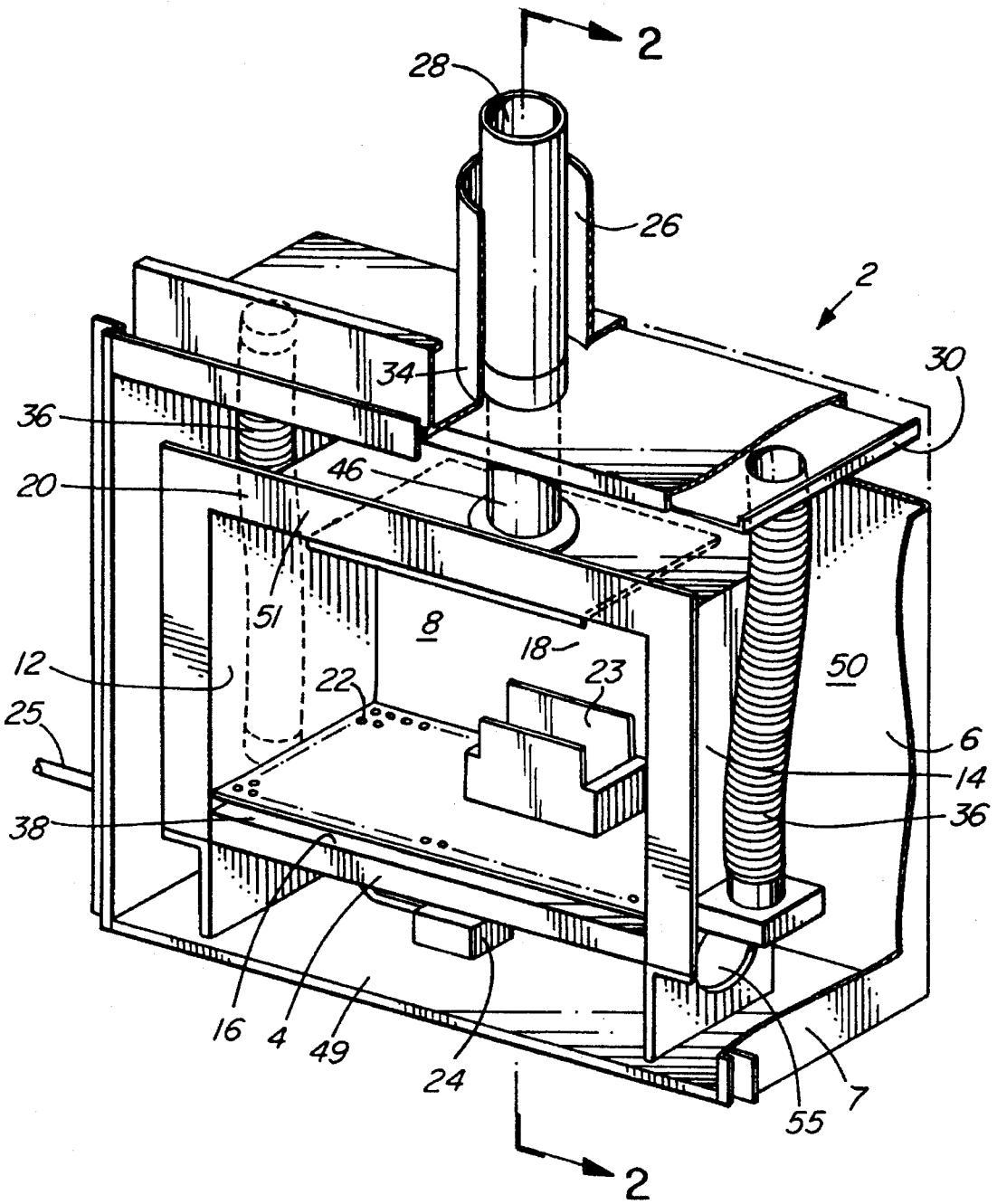
FIG. 1 is a perspective view of a fireplace insert according to the present invention with the manifold positioned in a top vent configuration.

Referring to FIG. 1, there is shown a fireplace insert 2 according to the present invention that includes an enclosure 4 insertable within a fireplace cavity 6 to define a combustion chamber 8 for generating heat. Cavity 6 is fitted with a liner 7 and enclosure 4 is dimensioned such that when positioned within cavity 6 there is an air space about the enclosure defining a heat exchange cavity for the fireplace insert. Enclosure 4 is preferably formed from welded sheet metal panels that include side walls 12 and 14, raised base 16, rear wall 18 and top 20. Enclosure 4 has an open front face and side walls 12 and 14 can converge slightly as they extend rearwardly. In its completed form, the enclosure may have a partially open or sealed front to accomodate the type of gas unit being used. The flue gas exhaust can use gravity, B-vent, power vent or sealed balance flue venting. A perforated grill 22 is positioned above raised base 16. Grill 22 supports fuel to be burned or, in the case of a gas fireplace, supports a gas burner 23 that can hold artificial logs (not shown). In a gas fireplace, a gas supply unit 24 and a gas pipeline 25 is mounted below raised base 16 and extends upwardly through the base to communicate with burner 23.

A fresh air inlet 26 provides outside air to the fireplace insert and a combustion gas outlet 28 removes combustion gases from combustion chamber 8. In the illustrated embodiment, inlet 26 and outlet 28 are tubular ducts arranged co-axially such that outlet 28 is enclosed within inlet 26. Thus heated combustion gases exhausted from combustion chamber 8 through outlet 28 serve to pre-heat fresh air moving inwardly to the combustion chamber.

Figure 4:
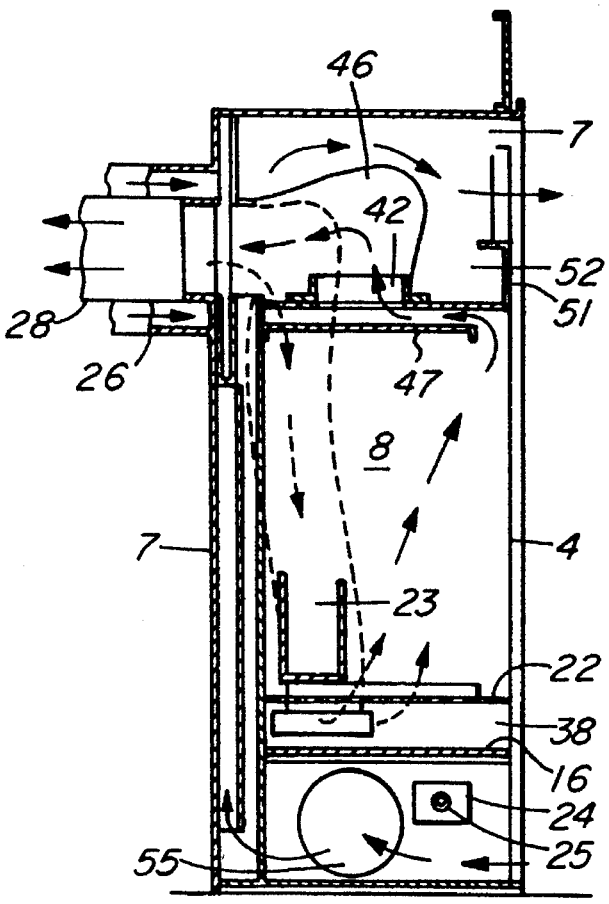
FIG. 4 is a section view of the fireplace insert with the manifold positioned in the rear vent configuration.
Figure 5:
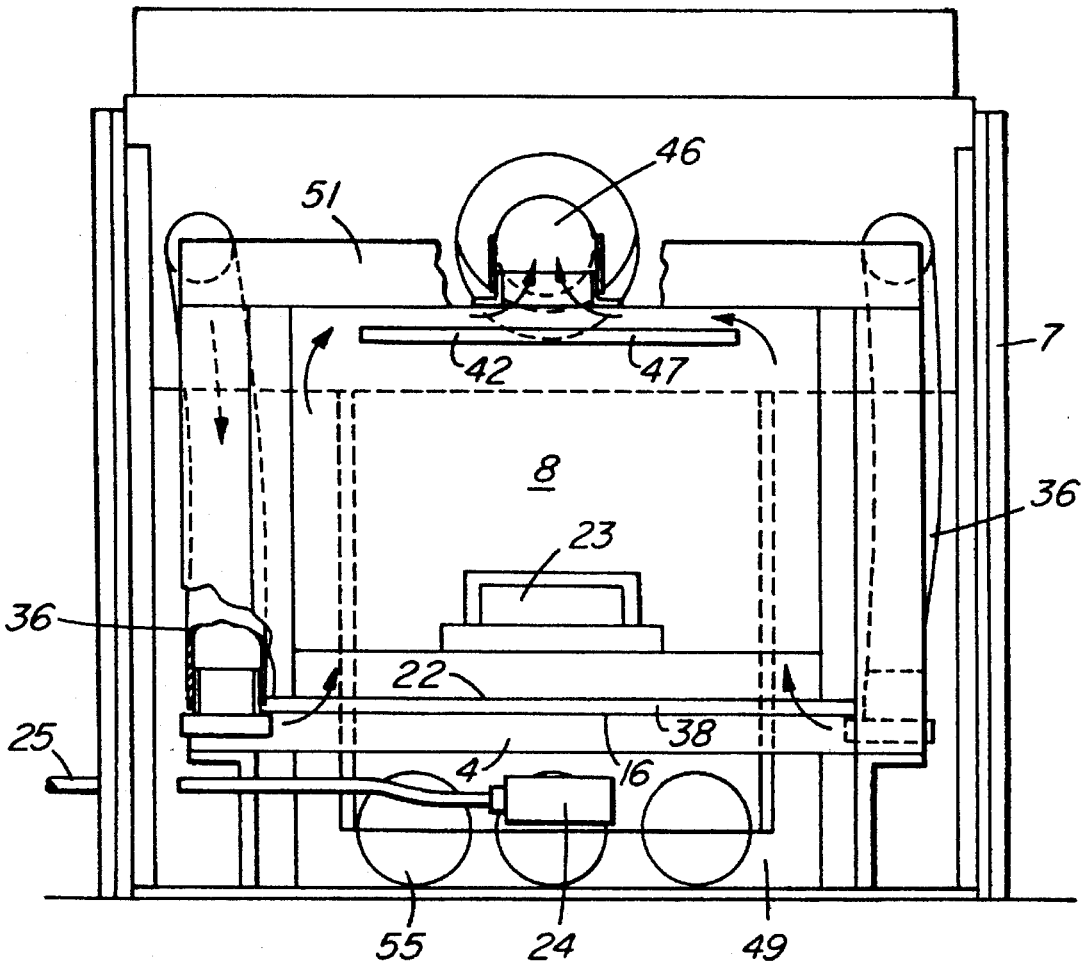
FIG. 5 is a front elevation view of the insert of FIG. 4.

Manifold means in the form of a thin essentially enclosure 30 distributes incoming fresh air from the fresh air inlet 26 to the combustion chamber 8. The manifold enclosure 30 is positionable at a predetermined location within the fireplace cavity according to the position of the fresh air inlet. In the embodiment, illustrated in FIGS. 1–3, the manifold enclosure is positioned above combustion chamber 8 in a top vent configuration such that inlet 26 and outlet 28 extend vertically above the fireplace cavity 6. In FIGS. 4–5, the manifold enclosure 30 is positioned behind combustion chamber 8 in a rear vent configuration in which inlet 26 and outlet 28 extend essentially horizontally rearwardly from the fireplace insert.

In either vent configuration, manifold enclosure 30 includes an intake 34 for connection with fresh air inlet 26 and a fresh air exhaust for delivering fresh air to the combustion chamber. Preferably, intake 34 is centrally located intermediate a pair of spaced fresh air exhausts in the form of flexible ducts 36 that extend downwardly in the space between liner 7 and enclosure side walls 12 and 14 to the combustion chamber. Ducts 36 communicate with chambers 38 that open into the space between base 16 and grill 22 to deliver fresh air directly below burner 23.

Figure 3:
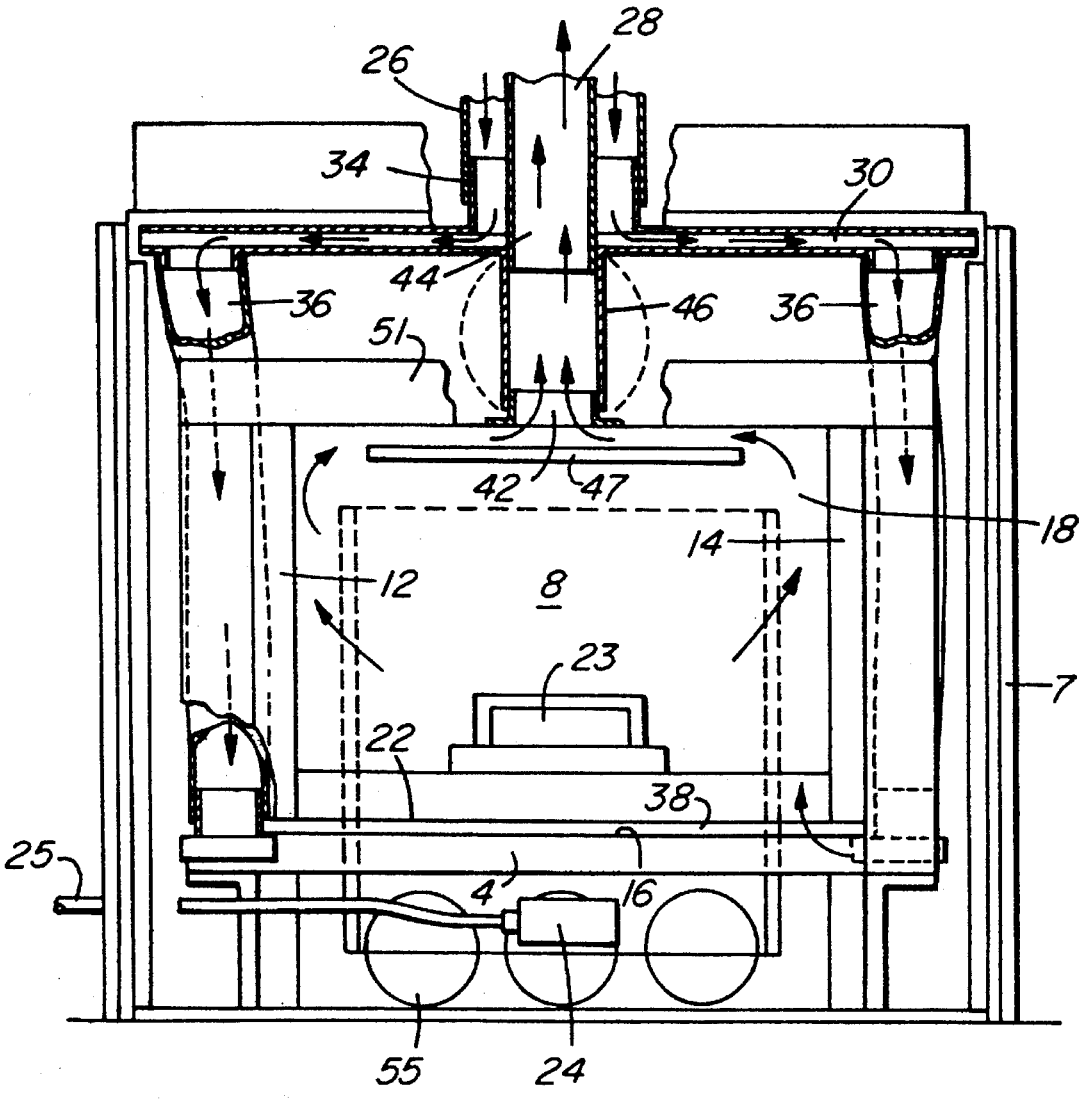
FIG. 3 is a front elevation view of the embodiment of FIG. 1.

Besides delivering fresh air to combustion chamber 8, it is also necessary to remove combustion gases. This is accomplished by connection means for communicating combustion chamber 8 with the combustion gas outlet 28. As best shown in FIG. 3, manifold enclosure 30 is preferably formed with a sealed passage extending therethrough to accommodate the connection means which comprises an outlet 42 in the top of the combustion chamber, a sealed tubular passage 44 extending through manifold enclosure 30 for connection with combustion gas outlet 28, and a flexible duct 46 connecting combustion chamber outlet 42 with tubular passage 44. In accordance with the co-axial arrangement of fresh air inlet 26 and combustion gas outlet 28, it is preferred that tubular passage 44 be positioned co-axially within manifold intake 34.

Pre-cut openings are formed in liner 7 to accomodate the top vent or rear vent configurations. One opening is blocked by a blank cover. Normally, units would be manufactured according to the top vent configuration. To convert to a rear vent configuration, the blank cover is moved to block the top vent opening and expose the rear vent opening.

Figure 2:
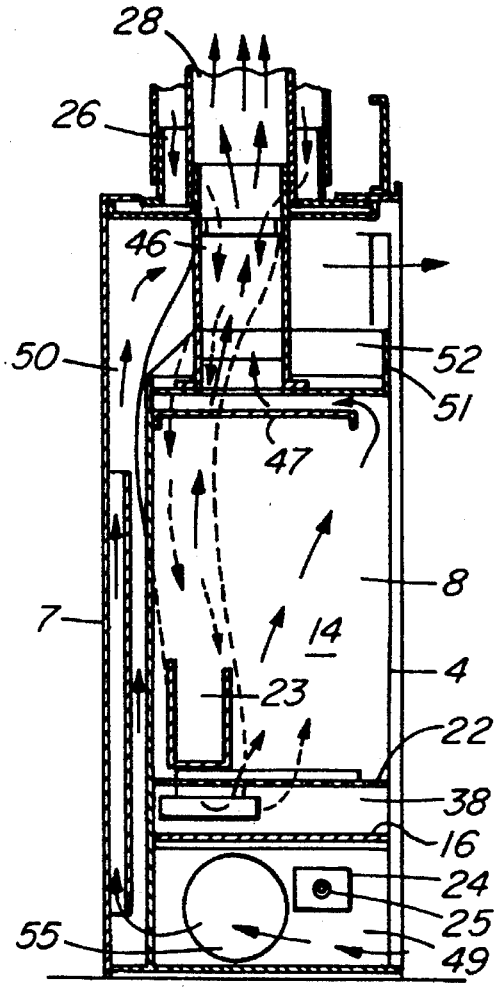
FIG. 2 is a section view taken along line 2—2 of FIG. 1.

Installation of a fireplace insert according to the present invention involves installing liner 7 in fireplace cavity 6. Inlet 26 and outlet 28 are inserted through the exposed pre-cut opening in liner 7. Manifold 30 is then installed by connecting intake 34 to inlet 26 and tubular passage 44 to outlet 28 using conventional fastening arrangements. If the manifold is installed in a top vent configuration, it will be positioned above combustion chamber 8 adjacent liner 7 as shown in FIG. 2. Alternatively, if the manifold is installed in a rear vent configuration, it will be positioned behind combustion chamber 8 adjacent liner 7 as shown in FIG. 4. In the rear vent configuration, flexible ducts 36 and 46 curve through approximately 90 degrees.

As best shown in FIGS. 3 and 5, air flow through the fireplace insert is indicated by arrows. Air flows in through inlet 28 and is divided within manifold enclosure 30 for flow through flexible ducts 36. Air from ducts 36 enters the lower region of combustion chamber when burning of fuel and production of combustion gases occur. Heated combustion gases rise and exit the insert through combustion chamber outlet 42 and flexible duct 46. A deflection plate 47 is provided to deflect downdrafts through outlet 28. The combustion gases pass through manifold enclosure 30 within tubular passage 44 and are exhausted to atmosphere through outlet 28. The combustion chamber, manifold, and inlet and outlet comprise a sealed system so that heated combustion air exiting the outlet creates a low pressure region in the combustion chamber that tends to draw in fresh air through the inlet in a natural convection circulation. Of course, fans (not shown) can be installed to assist in movement of the air.

The fireplace insert of the present invention includes heat exchanging means for accepting relatively cool building air, warming the air using the heat generated in the combustion chamber and delivering the warmed air back to the building. This heat exchanging means comprises a heat exchange cavity formed between liner 7 and enclosure 4. The cavity includes a cool air inlet cavity 49 below base 16 of the combustion chamber, an air heating chamber 50 extending behind and about the sides of enclosure 4, and a heated air outlet cavity 52 above the enclosure. A series of apertures 55 are formed in enclosure side walls 12 and 14 and enclosure rear wall 18 below base 16 to permit air flow from inlet cavity 49 to heating chamber 50. A finishing surround (not shown) with a vent overlying outlet cavity 52 is installed about the edges of the fireplace insert to permit heated air to flow back into the room.

Combustion chamber 8 has an open front face bordered by a sealing surface comprising a flange 51 that extends outwardly away from the combustion chamber substantially in the plane of the open front face. A glass plate or glass doors can be positioned across the open front face for engagement with a sealing member on flange 51. For example, the sealing member can be a bead of silicon sealant. In conventional designs, the sealing surface is often a flange that extends inwardly into the plane of the open face of the combustion chamber. This conventional arrangement exposes the sealing surface and the sealing member to the heat of the combustion chamber which leads to deterioration of the sealing member and leaking of combustion gases. The outwardly extending sealing flange of the present application removes the sealing member from direct heating by the combustion chamber and prolongs the life of the seal.

Although the present invention has been described in some detail by way of example for purposes of clarity and understanding, it will be apparent that certain changes and modifications may be practised within the scope of the appended claims.

I claim:

1. A fireplace insert for a fireplace cavity formed in a building, the cavity having a fresh air inlet and a combustion gas outlet comprising:

an enclosure having top, rear, bottom, and two side panels and an open front dimensioned to be insertable within the fireplace cavity to define a combustion chamber for generating heat;

a movable manifold chamber separate from the combustion chamber having an intake for connection with the fresh air inlet and first flexible duct means communicating with the combustion chamber for distributing fresh air to the combustion chamber; and second flexible duct means communicating the combustion chamber with the combustion gas outlet; and wherein the moveable manifold chamber is mountable within the fireplace cavity in at least a position adjacent the rear panel of the combustion chamber and a position adjacent the top panel of the combustion chamber to render the fireplace insert configurable for connection to the cavity inlet and outlet regardless of the positioning of said cavity inlet and outlet in the fireplace cavity.

2. An insert in claim 1 in which the manifold chamber includes an intake intermediate a pair of spaced fresh air exhausts.

3. An insert as claimed in claim 1 including a sealed tubular passage extending through the manifold chamber and communicating with the combustion gas outlet; and wherein the second flexible duct extends between the combustion chamber and the tubular passage.

4. An insert as claimed in claim 3 in which the combustion gas outlet and the fresh air inlet are ducts arranged co-axially and the sealed tubular passage extending through the manifold chamber is positioned co-axially within the manifold chamber intake, the fresh air inlet being secured to the manifold intake and the combustion gas outlet being secured to the sealed tubular passage.

5. An insert as claimed in claim 1 in which the enclosure includes heat exchanging means for accepting relatively cool building air, warming the air using the heat generated in the combustion chamber and delivering the warmed air back to the building.

6. An insert as claimed in claim 5 in which said heat exchanging means comprises:

a heat exchange cavity formed about the combustion chamber that includes a cool air inlet cavity below the combustion chamber, an air heating chamber, and a heated air outlet cavity above the combustion chamber.

7. An insert as claimed in claim 6 including a liner for the fireplace cavity, the space between the liner and the combustion chamber defining the heat exchange cavity.

8. An insert as claimed in claim 1 in which the open front of the combustion chamber enclosure is bordered by a sealing surface, a sealing member and means for covering the combustion chamber positionable across the front face for sealable engagement with the sealing member.

9. An insert as claimed in claim 8 in which the sealing surface comprises a flange that extends outwardly away from the combustion chamber substantially in the plane of the open front.

10. An insert as claimed in claim 8 in which the means for covering the combustion chamber comprises a glass plate.

* * * * *